United States Patent [19]

Omholt et al.

[11] 4,423,573

[45] Jan. 3, 1984

[54] WALL PANEL WITH REMOVABLE ACOUSTICAL INSERT

[75] Inventors: Bruce D. Omholt; Robert L. Knapp, both of Grand Rapids, Mich.

[73] Assignee: American Seating Company, Grand Rapids, Mich.

[21] Appl. No.: 958,784

[22] Filed: Nov. 8, 1978

[51] Int. Cl.[3] ..... E04B 1/84

[52] U.S. Cl. ..... 52/145; 52/475; 52/489

[58] Field of Search ..... 52/144, 475, 714, 489, 52/145; 428/192, 170; 181/284, 290, 291, 293, 294; 24/73 B, 73 BC

[56] References Cited

U.S. PATENT DOCUMENTS

| | | | |
|---|---|---|---|
| 1,940,969 | 12/1933 | Randall | 52/511 |
| 2,262,426 | 11/1941 | Hall | 52/511 |
| 2,903,815 | 9/1959 | Van Buren | 52/511 |
| 3,077,426 | 2/1963 | Johnston | 52/594 |
| 3,286,412 | 11/1966 | Greig | 52/475 |

*Primary Examiner*—John E. Murtagh

*Attorney, Agent, or Firm*—Emrich, Lee, Brown & Hill

[57] ABSTRACT

A wall panel includes a peripheral metal frame which may be free-standing or part of an open office partition system, and a removable acoustical insert. The acoustical insert is formed of pressed glass fiber and includes an integral border of substantially greater density than the main body portion of the insert to add rigidity to the insert and provide a stiffened portion for mounting clips which are used to removably secure the acoustical insert to the peripheral metal frame so that the border is in register with the frame.

6 Claims, 10 Drawing Figures

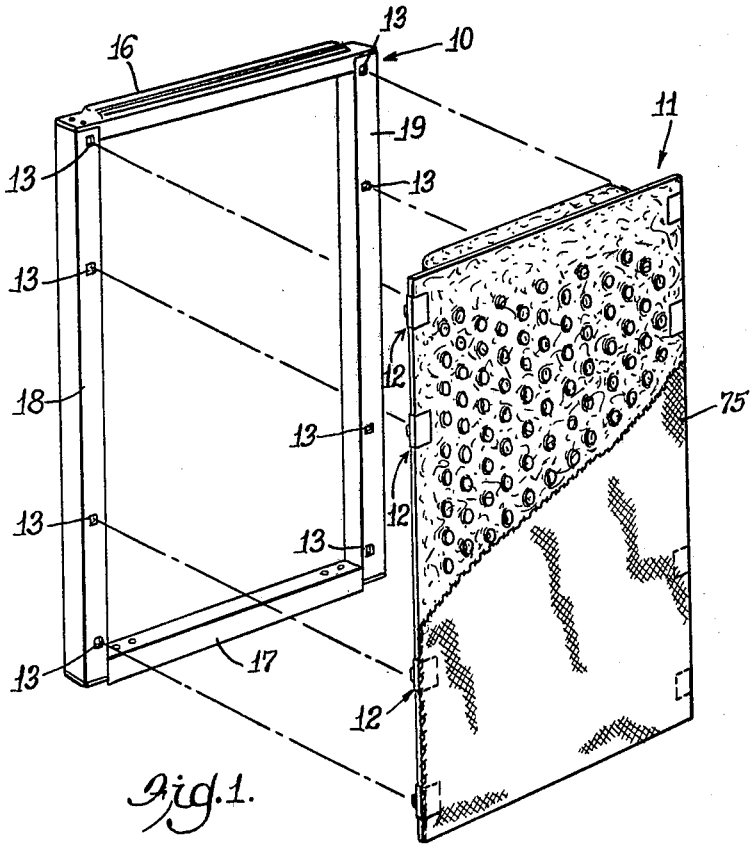
Fig. 1.
Fig. 2.
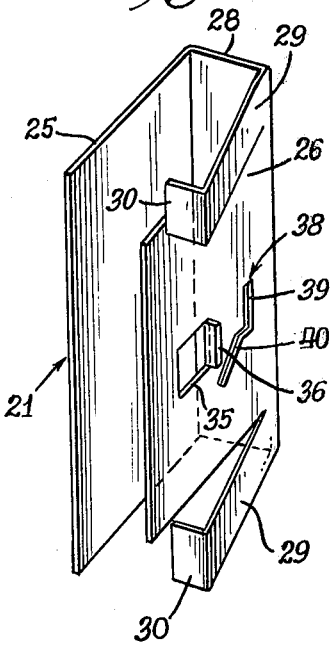
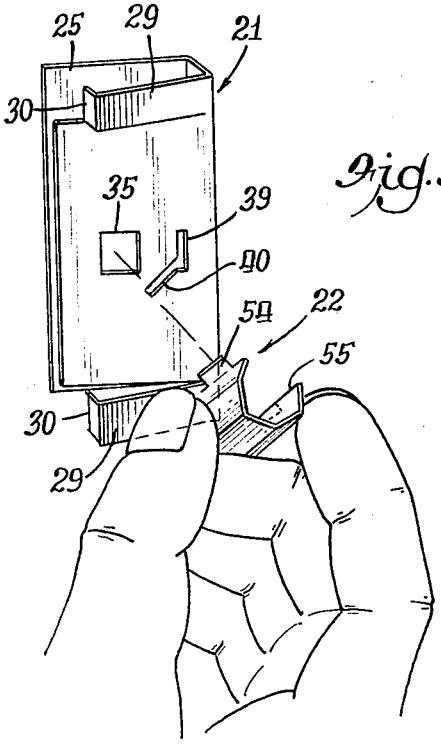
Fig. 3.
Fig. 4.
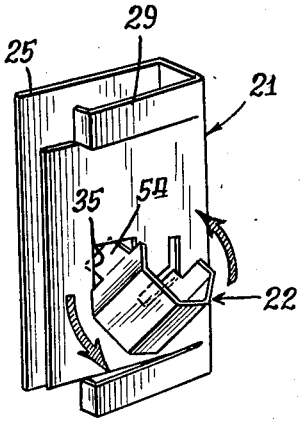
Fig. 5.
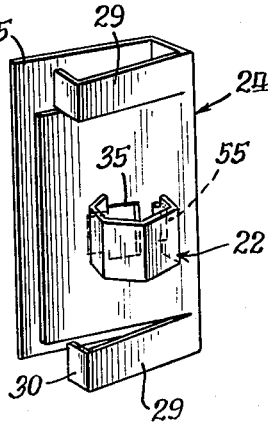

Fig. 7.
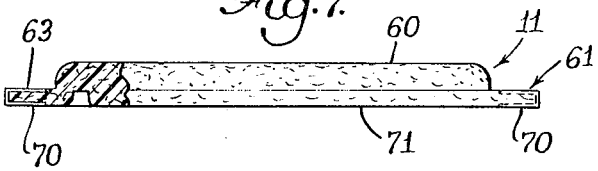
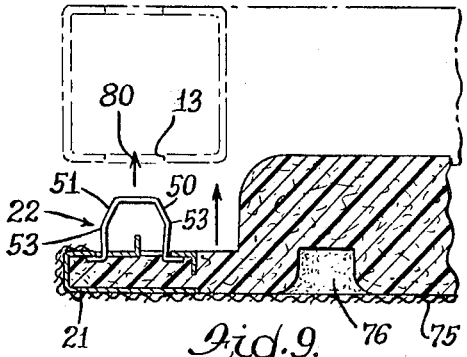
Fig. 9.
Fig. 6.
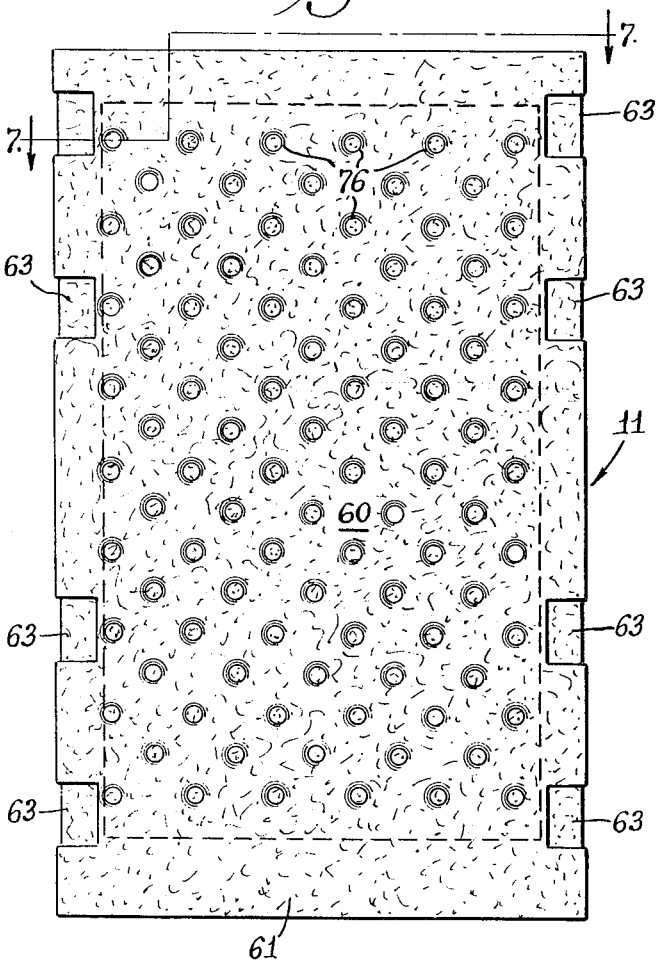
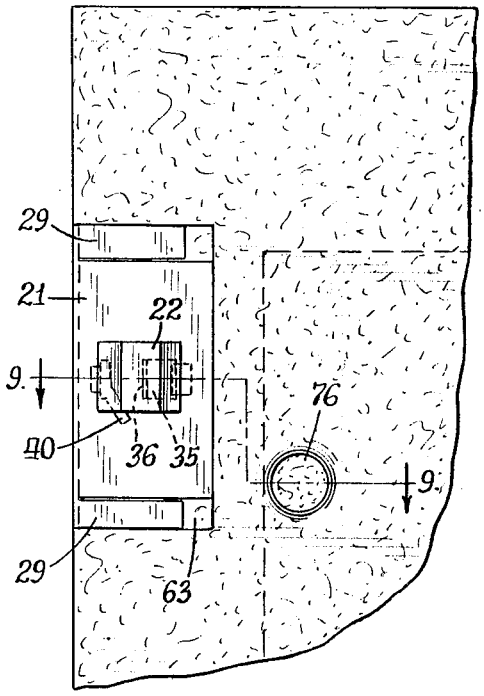
Fig. 8.
Fig. 10.
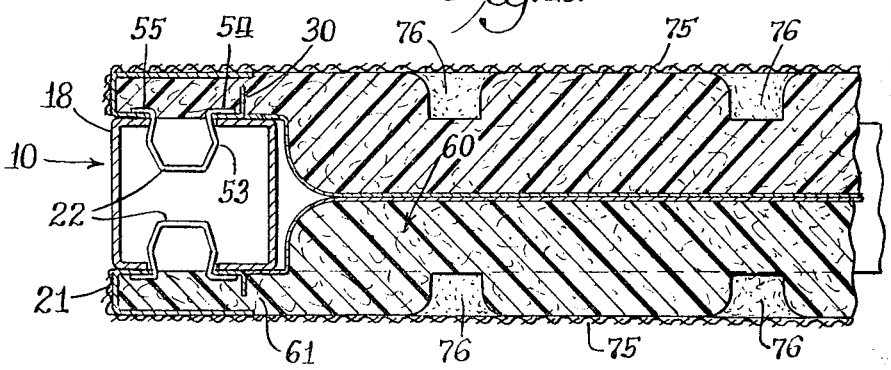

WALL PANEL WITH REMOVABLE ACOUSTICAL INSERT

BACKGROUND AND SUMMARY

The present invention relates to acoustical panels—that is, panels which are used to absorb incident sound and to prevent transmission of sound from one location to another. In recent years, with the commercial success of open plan systems (such as are in widespread use in offices and schools), there has been a need to provide an acoustical panel as a wall partition. Although the present invention is not so limited, it has particular utility as an individual wall panel in an open plan system. As such, it may be free-standing, or it may be interconnected with adjacent wall panels, whether or not such adjacent panels are acoustical.

Currently available acoustical panels for open office systems include panels of pressed glass fiber made according to conventional technology. Pressed glass fiber panels find frequent use in acoustical applications in ceiling tiles, liners for engines or construction vehicle cabs, as well as other applications where it is desired to reduce the ambient noise level.

Pressed glass fiber has many advantages as a building material useful for acoustical control. When such materials have, in the past, been used as part of a wall panel in an open plan system, the pressed glass fiber has been cut and molded into a panel of desired shape and thickness, and then fitted with a peripheral metal frame which is then used to secure the panel to a tubular metal frame of a wall panel. Although this construction is acceptable, it is also expensive to manufacture, requiring tooling for the peripheral frame and costly fabrication techniques. The exposed frames also provide a surface for reflecting sound and reducing the total surface of the absorbent material. In addition, some objections may be raised to the aesthetic look of metal-framed, fabric-covered wall panel.

The present invention overcomes the disadvantages of the prior art by substantially reducing manufacturing costs for an acoustical wall panel and by making it possible for the fabric to extend completely across the face of the panel and even around the sides of the panel so that a uniform fabric look is presented to the occupant of an office defined by the wall panels. Further, there is no exposed metal frame for reflecting incident acoustical energy.

The present invention includes a tubular metal frame adapted to be placed in an upright position and to receive an acoustical insert. Toward this end, the insert includes a panel of pressed glass fiber having a central body portion and a border formed integrally. The border has a density substantially greater than the average density of the central body portion. By "substantially," it is meant that the density of the glass fiber in the border is about seven times as great as the average density of the fiber in the central body portion. Further, the border is pressed toward the front or face of the insert so that the front surfaces of the border and central body portion are flush. This presents a uniform appearance to an observer, and permits a covering material, such as fabric, to cover the panel completely, edge to edge, which enhances the appearance of the panels.

The acoustical insert is removably connected to the tubular metal support frame; and this is a accomplished by providing a plurality of apertures in the side members of the tubular metal frame. These apertures form receptacles for spring clips which are mounted to the pressed border of the insert, in register with associated apertures on the metal frame.

In the illustrated embodiment, the spring clips are mounted to spring clip supports which are coupled to the border of the panel by pressing a turned tab into the border. A spring clip is secured to an associated support by an insert-and-twist motion, thereby securing the clip to its support while permitting the clip to flex in connecting the insert panel to the tubular metal frame.

The present invention thus provides a structure which is flexible in use, pleasing in appearance, economical to manufacture, yet adaptable to many different sizes and arrangements using standard components and materials.

Other features and advantages of the present invention will be apparent to persons skilled in the art from the following detailed description of a preferred embodiment accompanied by the attached drawing, wherein identical reference numerals will refer to like parts in the various views.

THE DRAWING

FIG. 1 is a perspective view of a wall panel constructed according to the present invention with the tubular metal frame and acoustical insert in exploded relation;

FIG. 2 is a perspective view of a clip support for the acoustical insert;

FIG. 3 is a perspective view illustrating the assembly of a clip to an associated clip support;

FIG. 4 is a fragmentary perspective view illustrating the twisting motion for assembling a clip to a clip support;

FIG. 5 is a fragmentary view similar to FIG. 4 showing the clip assembled to the support;

FIG. 6 is a front elevational view of the acoustical insert of FIG. 1;

FIG. 7 is a partially-sectioned top view of the insert of FIG. 6 taken through the sight line 7—7 thereof;

FIG. 8 is a close up fragmentary front view of a clip and clip support assembled to an acoustical insert;

FIG. 9 is a horizontal cross sectional view taken through the sight line 9—9 of FIG. 8, and illustrating the assembly of an insert panel to a tubular peripheral frame of a wall panel system; and FIG. 10 is a fragmentary top view of an acoustical insert assembled to a peripheral metal frame, with the frame sectioned.

DETAILED DESCRIPTION

Referring first to FIG. 1, a wall panel is shown as including a tubular metal frame 10 and an acoustical insert generally designated 11. The insert 11 is assembled to the frame 10 by means of clip assemblies, generally designated 12 which removably couple to associated receptacles in the form of apertures 13 in the metal frame.

The frame 10 includes upper and lower horizontal tubular elements 16, 17 which are welded respectively to the tops and bottoms of first and second upright side tubular members 18, 19 to form a rigid tubular metal frame.

The apertures 13 are formed in the front surface of the upright tubular side members 18, 19; and it is understood that similar apertures are formed in the back surfaces of these frame members so that a similar acoustical insert (or other insert) may be assembled to the other side of the frame 10. Any such insert could be similar in construction to the one illustrated and to be described in more detail presently, so further description of it is not necessary for a complete understanding of the invention.

Referring now to FIGS. 2–5, the clip assembly 12 comprises a clip support generally designated 21 and best seen in FIG. 2, and a clip generally designated 22 in FIGS. 3–5. The clip support 21 has a general channel shape including a generally flat front plate 25, a rear plate 26, and an interconnecting side portion 28. The top and bottom of the rear plate 26 are cut to form upper and lower hinges 29. The distal ends of the hinges are bent inwardly to form feet 30. The supports are assembled to the panel by placing the support over the border and pressing the hinges inwardly until the feet 30 are embedded in the panel, as seen in FIGS. 9 and 10.

The rear plate 26 includes a first generally rectangular die cut aperture or slot square 35 at one side of which a tab 36 is struck to extend outwardly. A second slot 38 is formed spaced from the slot 35. The slot 38 includes a generally rectangular slot portion 39 which is in lateral register with a side of the slot 35, and a lead-in slot portion 40 which extends at an acute included angle from the aperture 39 and is located on the side of aperture 39 in which the aperture 35 is formed. Preferably, the longer sides of the rectangular slot 40 are parallel to a diagonal of the square slot 35.

Referring now to FIGS. 3, 4, 9 and 10, the clip 22 includes five flat sides formed in a generally octagonal shape so as to provide lead-in surfaces 50, 51 for assembling the clip to one of the apertures 13, and retaining edges 53 for holding the clip assembled once it is inserted. The clip also includes a first laterally extending tab 54 which is sized to fit diagonally into the aperture 35 on the clip support 21 (as illustrated by the arrows in FIG. 3), and a second tab 55 which is sized to be received in the inclined slot 40 when assembling the clip 22 to the clip support 21. The tab 55 has a larger width than the slot 39 so that it cannot be removed directly.

To assemble the clip 22 to the clip support 21, the tab 54 is inserted into the aperture 35 with the tab extending diagonally across the aperture, as seen in FIG. 4. In this position, the tab 55 on the other side of the clip aligns with the slot 40, the axis of the slot 40 being parallel to the diagonal of the slot 35 (see FIG. 3). With both tabs held beneath the clip support, the clip is then rotated to bring the tab 55 of the clip in alignment with the slot 39. When the clip is thus rotated, the outwardly extending tab 36 on the clip support prevents removal of the tab 54 from the slot 35 and the tab 55 is too large to be removed from the slot 39. Thus, when the clip is rotated to the assembled position, it is secured to the clip support, as illustrated in FIGS. 5, 9 and 10.

Turning now to FIGS. 6 and 7, the acoustical panel includes a central body portion 60 and a peripheral border 61, both of which are formed of pressed glass fiber in a single step. However, the mold is shaped (and additional layers are added) such that the density of the fiber in the peripheral border 61 is substantially greater than the density of the fiber in the central body portion 60, thereby providing rigidity to the overall panel. In one embodiment, the thickness of the central body portion 60 is approximately three times that of the thickness of the peripheral border 61 (nominal 1.00 in. and 0.35 in. respectively). Portions of the peripheral border are compressed even further as at 63 (see FIG. 6) to accommodate the width of the clip support 21 so that its exterior is flush with the outer surface of the border, as seen in FIG. 9.

It will also be observed from FIG. 7 that the front surface of the border, designated 70 is flush with the front surface 71 of the central body portion of the insert. Thus, when the outer surface of the insert is covered with fabric as at 75 in FIG. 1, or other sheet material, the fabric may be extended around the sides of the border and attached to the rear of the insert by adhesive or staples. The perimeter of the panel preferably corresponds to the perimeter of the tubular frame 10, so that an observer's eye is met primarily with the uniform fabric covering, rather than any substantial portion of the frame. The outer surface of the body portion 60 of the glass fiber insert may have a series of indentations 76 formed in it to enhance sound absorption. Additional details of the sound absorption characteristics of the panel may be found in the co-pending, co-owned application of James E. Sulewsky entitled IMPROVED ACOUSTICAL WALL PANEL, Ser. No. 958,784 filed 11-8-78, now U.S. Pat. No. 4,423,573.

When the clip 22 is assembled to the clip support 21, the clip support is placed in one of the recesses 63 with the clip extending rearwardly—that is toward the side on which the larger central body portion of the insert extends. The assembled clip is seen in FIG. 8.

Referring now to FIG. 9, an insert is assembled to the frame by simply pushing the clips into associated, registered apertures 13 in the direction of the arrow 80. Assembly is facilitated by the lead-in surfaces 50, 51. The inserts are held by the retaining edge 53. When assembled, the insert, border, clip, clip support, and tubular upright frame member appear as shown in FIG. 10.

As described above, the thickness of the border portion of the insert is substantially less than that of the central body portion. This permits the body portion to extend inwardly of, and be received within, the peripheral frame 10, as illustrated in FIG. 10. Further, the peripheral border adds rigidity to the insert. Such rigidity has been achieved in the illustrated embodiment by pressing the glass fiber to a substantially greater density than that of the central body portion, preferably at least five times the density of the body portion. If still greater rigidity is required, the border can be impregnated with resin which either cures chemically or sets thermally, but which adheres to the glass fibers to bind them together. For this purpose, an epoxy resin may be used.

Having thus described in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. A wall panel for an open office system comprising: a peripheral support frame including at least a front surface and adapted to be placed in an upright position; an acoustical insert panel including a central body portion and an integral border of glass fiber, said border having a density substantially greater than the average density of said main body portion, and adding rigidity to said insert panel, at least a major portion of said border overlying said front surface of said frame; receptacle means on said frame defining a plurality of apertures on said front surface; and a corresponding plurality of locking members on said insert panel border for removably coupling said insert panel to said frame, said locking members each comprising a spring clip adapted to be received in one of said apertures, each clip comprising a channel-shaped clip support and a clip member, said clip support being adapted for fitting over said border and having a front plate, a rear plate and a side portion interconnecting said front and rear plates, said plates being pressed against the border of said panel and held thereby, said clip member being carried by the rear plate of an associated support in alignment with an associated aperture on said frame and defining first and second lead-in surfaces and first and second oppositely extending tabs; said clip support defining first and second slots, one of said slots being adapted to diagonally receive one of said tabs of said clip member and the other of said slots including a first slot portion laterally aligned with a side of said first slot of said clip support and a second slot portion aligned with a diagonal of said first slot, whereby said second tab of said clip member may be inserted into said second slot portion and said clip member rotated so that said second tab enters said first slot portion of said second aperture and is locked to said clip support.

2. The apparatus of claim 1 wherein said panel border is further compressed to define recesses for receiving said clip supports, the outer surfaces of which are flush with the corresponding surfaces of said border.

3. The apparatus of claim 1 wherein one of said front and rear plates of said support is cut to define a bendable member, the distal end of said bendable member being formed inwardly to be imbedded in said panel border when said bendable member is pressed against said border to secure said support to said insert panel.

4. The apparatus of claim 1 wherein the front surface of said body portion and the front surface of said border of said insert are flush; and wherein the perimeter of said insert panel conforms substantially to the perimeter of said frame, whereby said insert panel border extends in front of said frame.

5. The apparatus of claim 4 further comprising a sheet covering for said insert panel extending around the edges of said border thereof and secured to the rear thereof.

6. The apparatus of claim 1 further comprising a tab struck outwardly from said first slot of said clip member to secure said clip member therein in said rotated position.

* * * * *